US006109744A

United States Patent [19]

Nishimura

[11] Patent Number: 6,109,744

[45] Date of Patent: Aug. 29, 2000

[54] ASYMMETRIC RESTRICTOR FOR INK JET PRINTHEAD

[75] Inventor: Hiroshi Nishimura, West Hills, Calif.

[73] Assignee: Hitachi Koki Imaging Solutions, Inc., Simi Valley, Calif.

[21] Appl. No.: 08/905,164

[22] Filed: Aug. 1, 1997

[51] Int. Cl.[7] ..... B41J 2/19

[52] U.S. Cl. ..... 347/92

[58] Field of Search ..... 347/92, 94, 154, 347/103, 111, 159, 127, 128, 17

[56] References Cited

U.S. PATENT DOCUMENTS

| | | | |
|---|---|---|---|
| 4,418,355 | 11/1983 | DeYoung et al. | 347/70 |
| 4,520,374 | 5/1985 | Koto | 347/94 |
| 5,870,126 | 2/1999 | Kondo et al. | 347/92 |

*Primary Examiner*—John Barlow
*Assistant Examiner*—Charles W. Stewart, Jr.
*Attorney, Agent, or Firm*—Pillsbury Madison & Sutro LLP

[57] ABSTRACT

An ink jet comprises a restrictor with an asymmetrical opening that creates a vortex in the ink flowing into an ink jet chamber. The vortex is created as the ink in an ink manifold is transferred from the ink manifold to the ink jet chamber. The asymmetrical geometry of the opening, in which a throat of the opening is laterally offset with respect to a vertical center line dividing the opening, creates a vortex in the ink flow within the ink jet chamber. The vortex creates a swirling motion which helps to sweep air bubbles trapped in the ink jet chamber toward an ink droplet ejection orifice so that an air bubble purge system can then easily expel the air bubbles through the ink droplet ejection orifice. By removing the trapped air bubbles, jet outages can be prevented.

16 Claims, 4 Drawing Sheets

ASYMMETRIC RESTRICTOR FOR INK JET PRINTHEAD

FIELD OF THE INVENTION

The present invention relates to an improved restrictor member for an ink jet apparatus and ink jet apparatuses and methods incorporating the same.

BACKGROUND OF THE INVENTION

Various forms of ink jet apparatuses have been developed for jetting liquid (or solid, hot melt) materials, such as inks, adhesives, modeling materials, and the like. One widely accepted ink jet apparatus configuration involves a plurality of individual ink jet devices arranged in one or more rows, each fed by a common ink manifold. Such an arrangement is employed in the ink jet apparatus described in U.S. Pat. No. 4,418,355 to DeYoung et al., issued Nov. 29, 1983 (incorporated herein by reference). The apparatus described by DeYoung et al. includes a row of ink jet devices which are individually controlled to eject droplets of ink in response to jetting impulses produced by transducers 204.

The DeYoung et al. ink jet apparatus is composed of a number of layered plates (best shown in FIG. 2 of the DeYoung et al. patent) which form numerous ink passages, reservoirs and chambers. For example, when constructed (with reference to FIG. 1 of the DeYoung et al. patent), the layered plates form a plurality of ink jet chambers 200 which are fed ink from a common reservoir manifold 212, through restrictor openings 214 in a restrictor plate member 216. The restrictor plate with the restrictor openings provides communication passages for delivering ink from the common reservoir manifold to each ink jet chamber. Embodiments of the present invention relate to improved restrictor members and ink jet apparatuses and processes employing the same.

For most solid ink or liquid ink jet apparatuses, air in the ink passages and chambers is one of the major contributing factors leading to jet outages in which the ink in an ink jet chamber of the apparatus is not jetted properly. Jet outages tend to occur when air bubbles trapped in the ink jet chamber of the apparatus absorb enough of the pressure applied by an energized transducer to inhibit the transfer of pressure to the ink or other liquid in the ink jet head.

The jet outages caused by trapped air bubbles seem to be more prevalent among hot melt or solid ink jet apparatuses, in which the ink exhibits a phase change during the "cold" start sequence. During the "cold" start sequence, a solid ink is liquified by being heated, so that the ink can be jetted for printing. The liquified ink again solidifies after a printing procedure is finished. Since the ink shrinks in volume during the solidification process, air pockets tend to form in the ink reservoir and flow paths within the apparatus. These air pockets create air bubbles in the ink during the next "cold" start sequence in which the ink is heated and liquified again. The air bubbles created during the "cold" start sequence can flow with the ink into the ink jet chambers and cause jet outages.

In order to remove unwanted air bubbles in the ink jet chambers, typical ink jet apparatuses have been equipped with air bubble purge systems which enable an operator to purge air bubbles trapped in the ink jet chambers. Pressurization and vacuum methods have been used to purge air bubbles.

Ink in a typical multi-jet ink jet apparatus flows from an ink reservoir to an ink manifold and then to a plurality of ink jet chambers through restrictor openings. A typical ink jet chamber has a restrictor on one end and an ink jet ejection orifice on the other end. The restrictor defines an opening through which ink passes from the manifold to the ink jet chamber. Conventional ink jet apparatuses employ a restrictor member, as shown in the De Young et al. patent, having openings that are each symmetrical with respect to a vertical center line. Such a conventional restrictor opening is shown herein in FIG. 3*a*. Referring to FIG. 3*a*, the opening 7 of the restrictor 9 has a circular upper portion 3, a rectangular lower portion 5 and a throat 4 connecting the upper portion 3 with the lower portion 5. An imaginary vertical center line 2 divides the opening 7 into two symmetrical (mirror image) halves. The throat 4 is located in the center of the opening 7, coaxial with the vertical center line 2.

The ink flow through the opening 7 of the restrictor 9 is represented by arrow 11 in FIG. 3*a*. FIG. 3*b* shows a cross-sectional view of the ink flow direction 11 through an ink jet chamber 14, the restrictor 9 and an ink manifold 240 of an ink jet apparatus. As shown by FIGS. 3*a* and 3*b*, the ink flow 11 can result in the conveyance or formation of air bubbles 50 in the ink jet chamber 220. Some air bubbles 50, especially the ones trapped in corners of the ink jet chamber, are not pushed toward the ink droplet ejection orifice 210 by the ink flow 11 and become trapped within the ink jet chamber. As a result, pressure pulse caused by actuations of the transducer 270 are at least partially absorbed by the air bubbles 50, instead of being fully transferred to the ink within the ink jet chamber for ejecting droplets.

SUMMARY OF THE DISCLOSURE

It is an object of the present invention to provide an improved method and apparatus for removing air bubbles trapped in an ink jet apparatus and preventing jet outages, obviating, for practical purposes, the above-mentioned limitations.

These and other objects and advantages are achieved by, in accordance with one aspect of the invention, an ink jet apparatus which comprises a restrictor with an asymmetrical opening that creates a vortex in the ink flowing into an ink jet chamber. The vortex is created as the ink in an ink manifold is transferred from the ink manifold to the ink jet chamber. The asymmetrical geometry of the opening, in which a throat of the opening is laterally offset with respect to a vertical center line dividing the opening, creates a vortex in the ink flow within the ink jet chamber. The swirling motion created by the vortex helps to sweep air bubbles trapped in the ink jet chamber, even the ones located in the comers of the ink jet chamber, toward the ink droplet ejection orifice. An air bubble purge system can then easily expel the air bubbles through the ink droplet ejection orifice since the air bubbles have been swept to the ink droplet ejection orifice by the ink flow. By removing the trapped air bubbles, jet outages can be prevented.

DETAILED DESCRIPTION OF THE PREFERRED EMBODIMENTS

Figure 1:
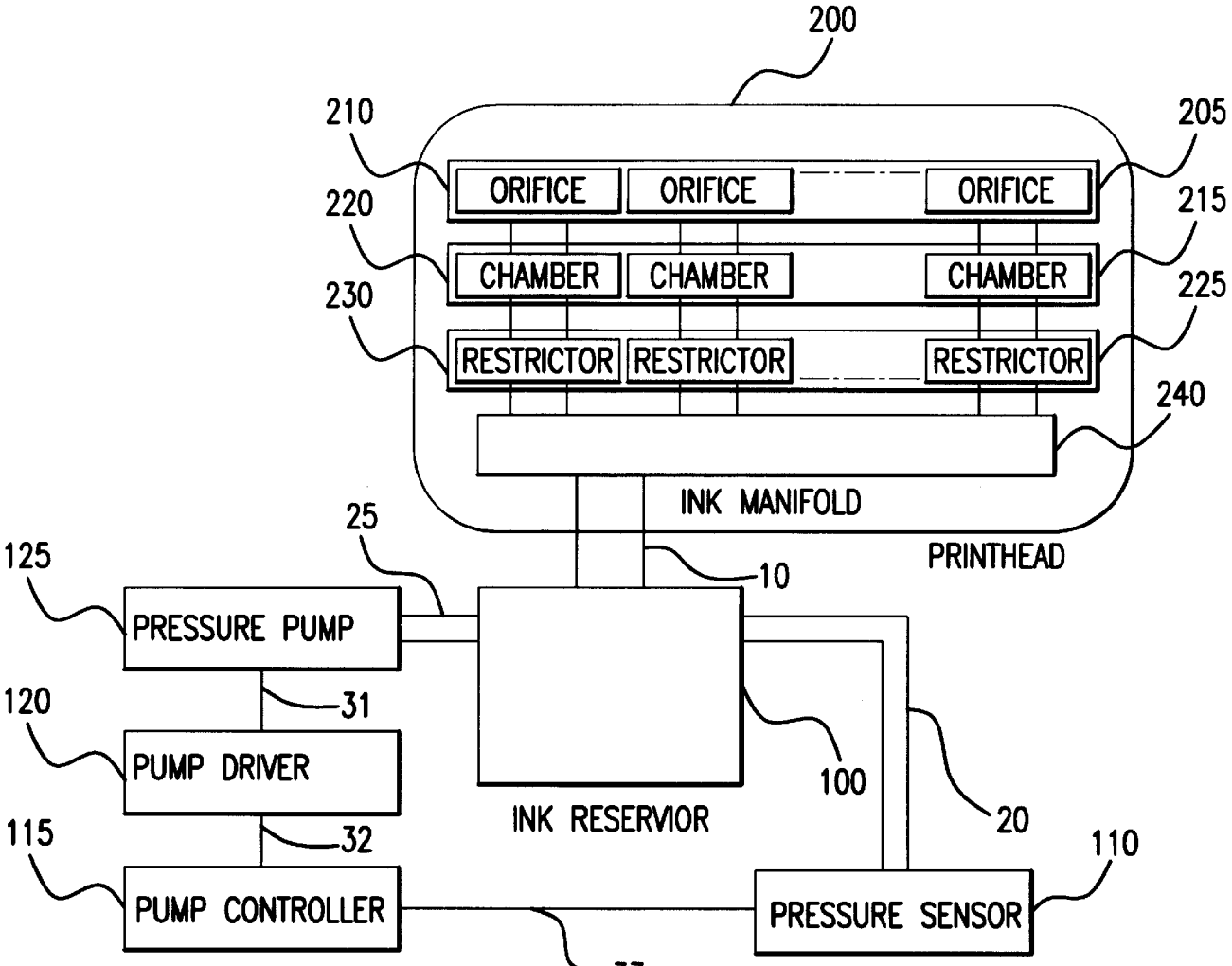
FIG. 1 is a block diagram illustrating the detailed structure of an ink jet apparatus including an air bubble purge system, according to an embodiment of the present invention.

Referring first to FIG. 1, an ink jet apparatus having plural ink jet devices and an air bubble purge system in accordance with a preferred embodiment of the present invention comprises a printhead 200, an ink reservoir 100, a pressure pump 125, a pump driver 120, a pump controller 115 and a pressure sensor 110. The printhead 200 further comprises an ink manifold 240 for containing ink, a restrictor member 225 including a plurality of individual restrictors 230, a chamber member 215 including a plurality of individual ink jet chambers 220 and an orifice member 205 including a plurality of individual ink droplet ejection orifices 210. The printhead 200 is also comprised of a diaphragm member (not shown in FIG. 1) and a transducer member (not shown in FIG. 1). In preferred embodiments, the ink manifold 240, the restrictor member 225, the chamber member 215, the orifice member 205, the diaphragm member and the transducer member are configured in plates that are bonded together to form the printhead 200. A manner of coupling plate-like members to form a printhead is described in the above-cited De Young et al. patent. When constructed, the printhead 200 forms plural ink jet devices 300, each ink jet device having an orifice 210, an ink jet chamber 220, a restrictor 230, a diaphragm and a transducer, as discussed below.

The ink manifold 240 in the printhead 200 is in fluid flow communication with the ink reservoir 100 through an ink connection flow path 10. The pressure pump 125 is operatively connected to the pump driver 120 through an electrical or mechanical connection 31, the pump driver 120 is also connected to the pump controller 115 through an electrical connection 32, and the pump controller 115 is also connected to the pressure sensor 110 through a connection 33. The pressure pump 125 and the pressure sensor 110 are connected to the ink reservoir 100 through pressure connection paths 25 and 20, respectively.

Air bubbles trapped in the ink jet chamber 220 can be purged by increasing pressure to the ink reservoir 100 through the pressure pump 125, which in turn will increase pressure in the ink jet chambers 220. The pressure applied in the ink jet chamber 220 will expel the ink, including the air bubbles trapped in the ink jet chamber 220 through the ink droplet ejection orifice 210.

Figure 2:
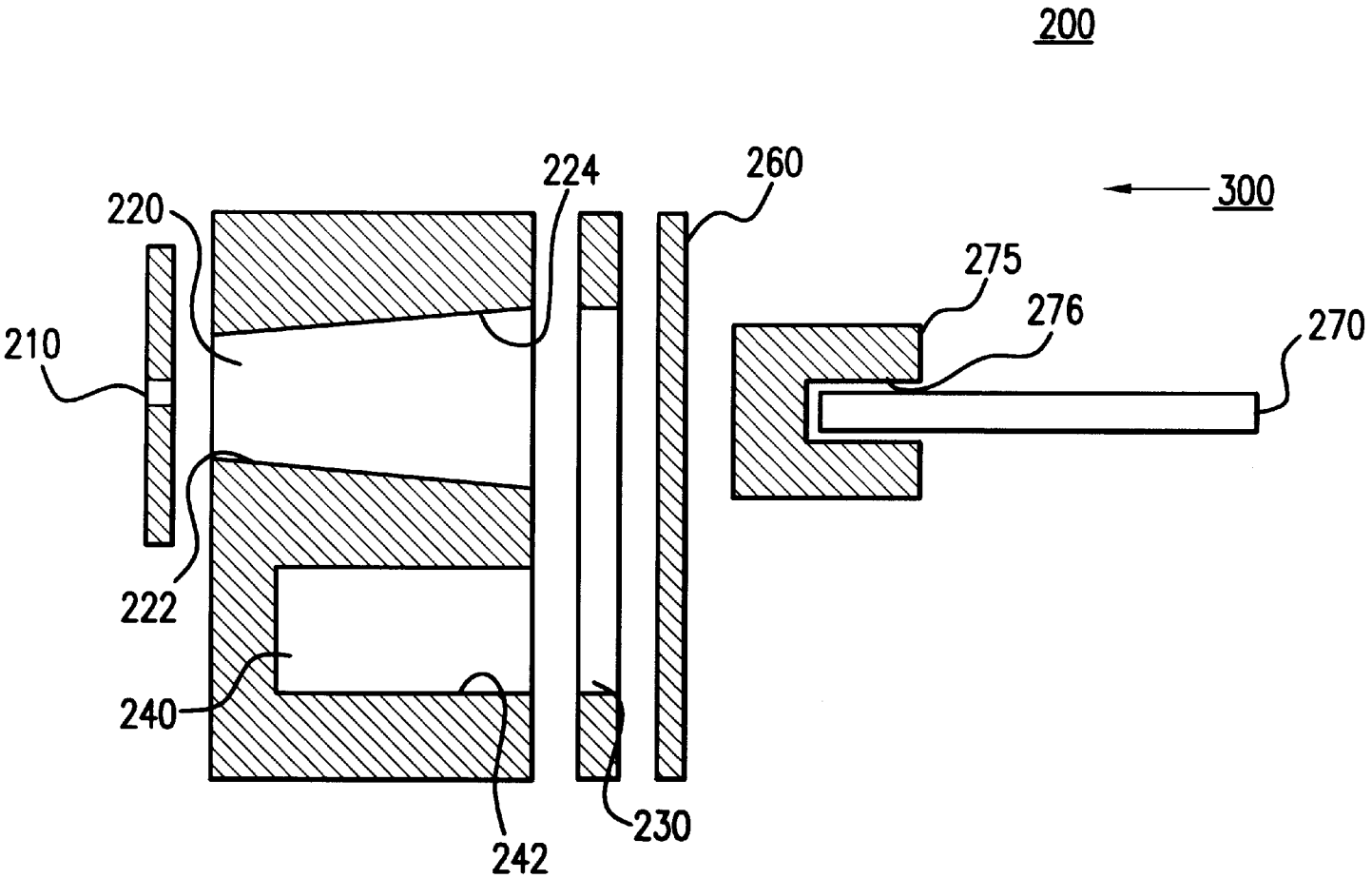
FIG. 2 is a cross-sectional view of a printhead of the apparatus in FIG. 1 before the bonding process.

FIG. 2 shows an exploded cross-sectional view of the printhead 200, showing one of the plural ink jet devices 300 of the printhead 200. Each ink jet device in the printhead includes a droplet ejection orifice 210, an ink jet chamber 220, a restrictor 230, a diaphragm 260, a foot 275 and a transducer 270. The ink jet device 300 operates to selectively eject droplets of ink from the ink jet chamber 220 through the ink droplet ejection orifice 210, in response to the selective energization of the transducer 270. As shown in FIG. 1, the printhead 200 is comprised of an array of the ink jet devices 300 arranged in a row.

The ink manifold 240 defines a hollow interior for containing ink and an opening 242 into the hollow interior. In the embodiment shown in FIG. 2, the manifold 240 is provided within the chamber member 215 (the plate-like member in which the chambers 220 are formed) and is in flow communication, through opening 242 and restrictor member 225, with each ink jet chamber 220. Each ink jet chamber 220 has an opening 224 formed on the same side of the chamber member 215 that the manifold opening 242 is provided. An opening 222 formed on the opposite of each ink jet chamber 220 communicates with a corresponding orifice opening 210.

As shown in FIGS. 1 and 2, the restrictor member 225 includes a restrictor 230 for each ink jet device. The restrictor 230 defines an opening for a flow path between the manifold opening 242 and the ink jet chamber opening 224. In operation, ink (or other jettable material) is conveyed from the manifold 240, through the restrictor opening 230 and into the ink jet chamber 220 for subsequent ejection according to well known jetting techniques.

Figure 3A:
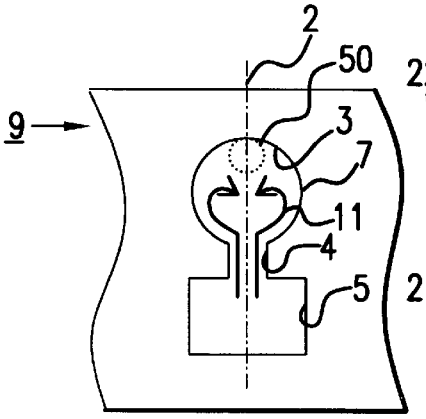
FIG.3a PRIOR ART
FIG. 3*a* is a front view of an opening of a restrictor in a conventional ink jet apparatus and an ink flow path going through the opening.

As discussed in the background section, the conveyance path for ink (or other jettable material) from a manifold 240, through a conventional restrictor opening 9 and into an ink jet chamber 220 is shown by arrow 11. The conventional restrictor opening 9 is best shown in FIG. 3*a* and resembles that described in the above-cited De Young et al. patent (see FIG. 2 of the De Young et al. patent), at least with respect to its symmetrical shape. More specifically, the conventional restrictor opening 9 shown in FIG. 3*a* is symmetrical about an imaginary center line 2 extending vertically (in the manifold-to-chamber direction) in FIG. 3*a*.

Figure 4A:
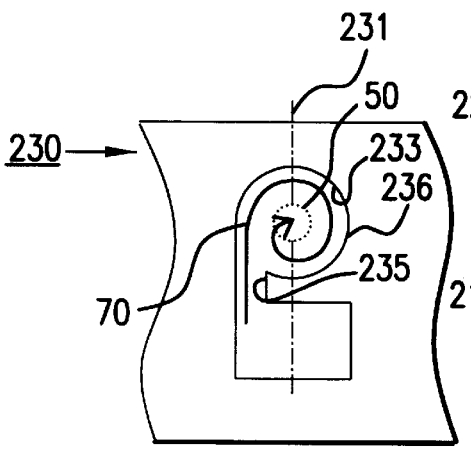
FIG. 4*a* is a front view of an opening of a restrictor according to the embodiment in FIG. 1 and an ink flow path going through the opening.

FIG. 4*a* shows a front view of the restrictor 230 in accordance with a preferred embodiment of the present invention. The restrictor 230 has an opening 236 with an upper portion 233, a lower portion 237 and a throat portion 235 connecting the upper and lower portions. An imaginary vertical center line 231 dividing the opening 236 is also shown in FIG. 4*a*. In the illustrated embodiment, the upper portion 233 is approximately circular in shape and the lower portion 237 is approximately rectangular in shape. The upper portion 233 has an approximately circular shape to match the shape of the ink jet chamber 220 which also has an approximately circular cross-sectional shape. However, the upper portion 233 and the lower portion 237 can have other types of shapes (e.g., a hexagonal shape). The throat 235 is connected to the upper corner of the lower portion 237 and to the lower corner of the upper portion 233, thereby connecting the upper portion 233 with the lower portion 237. The throat 235 is laterally offset with respect to the vertical center line 231 (instead of overlapping with the vertical center line 231 as in the conventional restrictor opening shown in FIG. 3*a*). In other words, the throat 235 is positioned to provide a generally tangential flow into the circular shaped upper portion 233, instead of being centered relative to the circular shaped upper portion 233 (as in the conventional restrictor opening shown in FIG. 3*a*). As a result, the opening 236 is asymmetrical with respect to the vertical center line 231 and the throat 235 is laterally offset with respect to the vertical center line 231. The opening 236 can be asymmetrical with respect to the vertical center line 231 and have a laterally offset throat even when the upper portion and the lower portion of the opening 236 have other types of shapes such as the hexagonal shape mentioned above.

Figure 4B:
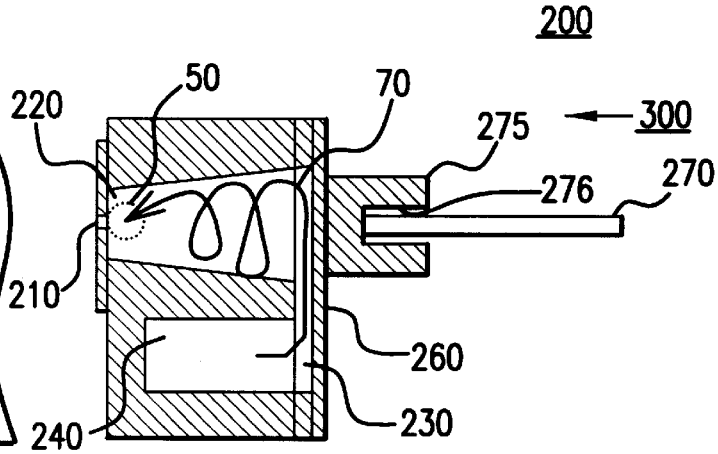
FIG. 4*b* is a cross-sectional view of a printhead according to the embodiment in FIG. 1 and an ink flow path going through the printhead.

FIG. 4*b* shows a cross-sectional view of the ink jet device 300 employing a restrictor 230 according to a preferred embodiment of the present invention. The elements in FIG.

Figure 3B:
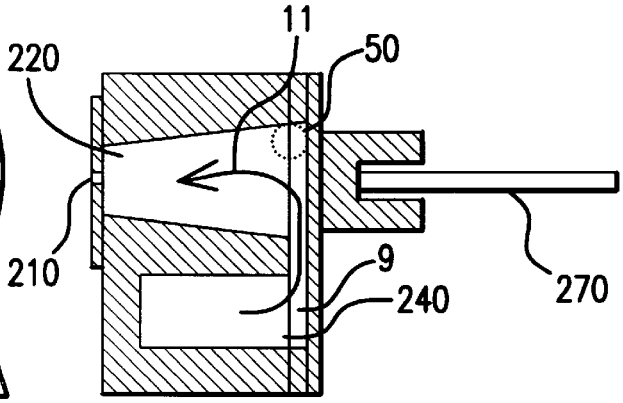
FIG.3b PRIOR ART
FIG. 3*b* is a cross-sectional view of a printhead in a conventional ink jet apparatus and an ink flow path going through the printhead.

4*b* with similar function to the elements in FIG. 3*b* have been labeled with same labels. The transducer 270 is coupled to the foot 275 by being inserted into the slot 276, and the foot 275 is disposed behind the diaphragm 260 such that the front surface of the foot 275 contacts the rear surface of the diaphragm 260. The diaphragm 260 is disposed behind the restrictor 230. Referring to FIGS. 2, 4*a* and 4*b*, the upper portion 233 of the opening 236 of the restrictor 230 is coupled to the opening 224 of the ink jet chamber 220, and the lower portion 237 of the opening 236 of the restrictor 230 is coupled to the opening 242 of the ink manifold 240 as shown in FIG. 4*b*. The vertical center line 231 of the restrictor 230 is approximately aligned with a vertical center axis dividing the ink jet chamber 220. The ink droplet ejection orifice 210 is coupled to the front of the ink jet chamber 220 such that the ink droplet ejection orifice 210 leads into the opening 222 of the ink jet chamber 220.

The opening 236 of the restrictor 230 forms a channel between the ink jet chamber 220 and the ink manifold 240 so that the ink in the ink manifold 240 can be transferred to and received by the ink jet chamber 220. The ink in the ink manifold 240 passes through the opening 236 before reaching the ink jet chamber 220. In addition to forming a channel to the ink jet chamber 220 from the ink manifold 240, the opening 236 restricts the ink flow in the opposite direction and helps to build the impulse pressure for jetting the ink in the ink jet chamber 220 through the ink droplet ejection orifice 210.

The selective energization of the transducer 270 causes selective expansion or contraction of the transducer 270 to selectively push the foot 275 against the diaphragm 260. The diaphragm 260 flexes toward the interior of ink jet chamber 220 in response to the force applied by the foot 275. The motion of the diaphragm 260 creates the pressure variances for drawing ink (or other jettable material) into the chamber and jetting the ink from the ink jet chamber 220 through the ink droplet ejection orifice 210 in a well known manner, such as described in the above-cited DeYoung et al. patent. As a result of a contraction of the transducer, the ink (or other jettable material) from the ink manifold 240 is drawn from the ink manifold 240, through the opening 236 of the restrictor 230 and into the ink jet chamber 220.

After the ink in the ink manifold 240 has passed through the lower portion 237, the throat 235 and the upper portion 233 of the opening 236 and reaches the ink jet chamber 220, the position and orientation of the flow path of the ink (or other jettable material) relative to the ink jet chamber 220 creates a vortex 70 in the ink flow within the ink jet chamber 220. The asymmetrical geometry of the opening 236, in which the throat 235 is laterally offset with respect to the vertical center line 231 and is preferably directed so that ink (or other jettable material) flows substantially tangential to the circular upper portion 233 and the corresponding circular cross-section of the ink jet chamber 220, creates the vortex 70 as shown in FIG. 4*a*. The swirling motion created by the vortex 70 has been found to help sweep the air bubbles 50 trapped in the ink jet chamber, even the bubbles located along side edges or in the corners of the ink jet chamber 220, toward the ink droplet ejection orifice 210. Therefore, the air bubbles 50 can be more easily expelled through the ink droplet ejection orifice 210 using the purging system mentioned above. The opening 236 can employ other types of shapes for the upper portion and the lower portion to create a vortex in the ink jet chamber 220.

Figure 5A:
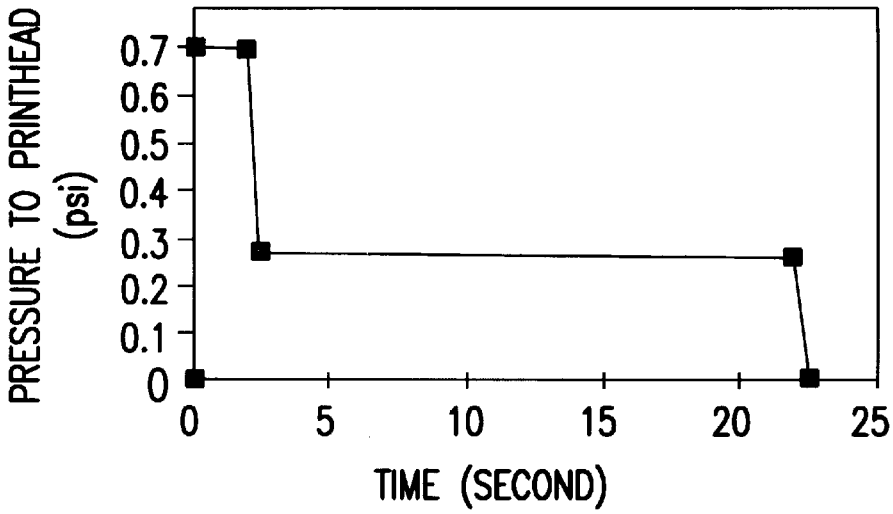
FIG. 5*a* is a plot of the pressure applied to the printhead during an air bubble purge operation.
Figure 5B:
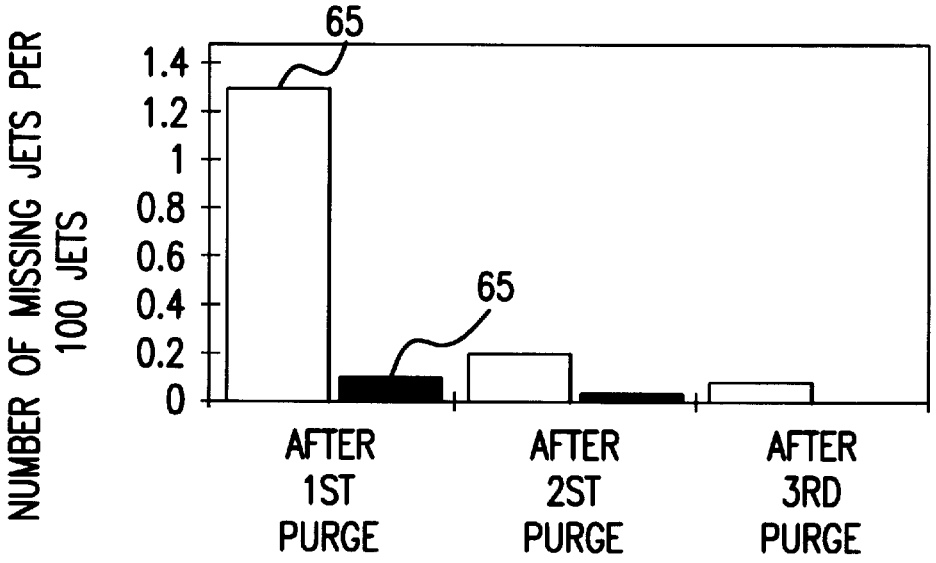
FIG. 5*b* is a graph comparing the number of missing jets for a conventional ink jet apparatus and the ink jet apparatus according to the embodiment shown in FIG. 1.

In order to compare the performance of a conventional restrictor to the performance of a restrictor in accordance with preferred embodiments of the present invention, FIG. 5*b* shows the number of missing jets per 100 jets after first, second and third attempted purges of the trapped air bubbles. The number of missing jets for an ink jet apparatus using a restrictor with an asymmetrical opening in accordance with preferred embodiments of the present invention is shown with solid bars 60, and the number of missing jets for an ink jet apparatus using a conventional restrictor is shown with blank bars 65. As shown in FIG. 5*b*, the ink jet apparatus using a restrictor with an asymmetrical opening in accordance with the present invention has a far less number of missing jets when compared to the ink jet apparatus using a conventional restrictor. After the third purge, the ink jet apparatus using a restrictor in accordance with the present invention has no missing jets, whereas the ink jet apparatus using a conventional restrictor still has missing jets even after the third purge of air bubbles. FIG. 5*a* shows the pressure applied to the printhead with respect to the time taken by the air bubble purge system during an air bubble purge.

It will, of course, be understood that modifications of the present invention, in its various aspects, will be apparent to those skilled in the art, some being apparent only after study and others being matters of routine mechanical and electronic design. Other embodiments are also possible, their specific designs depending upon the particular application. As such, the scope of the invention should not be limited by the particular embodiments herein described but should be defined only by the appended claims and equivalents thereof.

What is claimed is:

1. An ink jet apparatus comprising:

an ink manifold containing ink;

an ink jet chamber for containing ink received from the ink manifold, said ink jet chamber including an ink droplet ejection orifice and an interior wall;

an ejection device for ejecting the ink in the ink jet chamber through the ink droplet ejection orifice; and a restrictor for transmitting ink from the ink manifold to the ink jet chamber including a throat which is positioned to direct ink along the interior wall of the ink jet chamber to create a vortex of the ink flowing into the ink jet chamber.

2. The ink jet apparatus of claim 1, wherein the the restrictor is coupled to the ink jet chamber and the restrictor includes a forward cavity formed over the ink jet chamber having a center, and wherein the throat directs the ink into the forward cavity in a direction which is substantially offset from the center of the forward cavity.

3. The ink jet apparatus of claim 2, wherein the restrictor is coupled to the manifold and the restrictor includes a rearward cavity formed over the manifold, and wherein the throat is coupled between the forward cavity and the rearward cavity to direct ink from the rearward cavity to the forward cavity.

4. The ink jet apparatus of claim 3, wherein the forward cavity has an approximately circular shape and the rearward cavity has an approximately rectangular shape.

5. The ink jet apparatus of claim 1, wherein the throat directs the ink along the inner wall of the ink jet chamber to create a vortex of the ink flowing into the ink jet chamber from the ink manifold.

6. The ink jet apparatus of claim 5, wherein a swirling motion created by the vortex transmits air from bubbles trapped in the ink jet chamber towards the ink droplets ejection orifice.

7. The method of claim 1, wherein the ink jet apparatus includes a restrictor coupled to the manifold and the ink jet chamber having the throat formed therein, method further includes transferring the ink from a rearward cavity formed in the restrictor to a forward cavity formed in the restrictor through the throat.

8. The method of claim 7, wherein the forward cavity includes substantially rounded portion conforming with the interior wall of the ink chamber.

9. A method of operating an ink jet apparatus, the method comprising the steps of:

storing ink in an ink manifold;

transferring the ink in the ink manifold to an ink jet chamber having an interior wall through a throat forming a channel between the ink manifold and the ink jet chamber and directing the ink to the interior wall of the ink jet chamber to create a vortex of the ink flowing into the ink jet chamber; and ejecting the ink through an ink droplet ejection orifice, wherein the ink directed along the interior wall of the ink jet chamber forms a vortex with swirling motion in the ink jet chamber.

10. The method of claim 9, further comprising the step of transmitting air from bubbles trapped in the ink jet chamber towards the ink droplet ejecting orifice by using said swirling motion of the vortex.

11. An ink jet apparatus comprising:

an ink manifold containing ink;

an orifice plate with a plurality of ink droplet ejection orifices;

an ink jet chamber plate with a plurality of ink jet chambers for containing ink received from the ink manifold, each of the ink jet chambers having an interior wall each of the plurality of ink droplet ejection orifices being positioned to eject ink in the ink jet chambers;

an ejection device plate with a plurality of ejection devices for ejecting the ink through each of the plurality of ink droplet ejection orifices; and a restrictor plate with a plurality of restrictors, each of the plurality of restrictors including a throat which forms a channel between each of the plurality of ink jet chambers and the ink manifold for transmitting the ink from the ink manifold to each of the plurality of ink jet chambers, wherein throat is positioned to direct ink along the interior wall of a corresponding one of the ink jet chambers to create a vortex of the ink flowing into the corresponding one of the ink jet chambers.

12. The ink jet apparatus of claim 11, wherein the the throat of each restrictor directs ink along the interior wall of a corresponding one of the ink jet chambers to create a vortex with a swirling motion in the ink flowing into each of the corresponding one of the ink jet chambers from the ink manifold.

13. The ink jet apparatus of claim 12, wherein the swirling motion of the vortex transmits air from bubbles trapped in the corresponding one of the plurality of ink jet chambers toward the ink droplet ejection orifice.

14. A restrictor plate for restricting a flow of ink in an ink jet apparatus, said restrictor plate comprising:

a plurality of restrictors, each of the plurality of restrictors having a throat adapted for transmitting ink into an ink jet chamber, wherein the throat of each restrictor is positioned to transmit ink into an ink jet chamber to create a vortex of the ink flowing into the ink jet chamber.

15. The restrictor plate of claim 14, wherein each restrictor includes a forward cavity adapted to couple to an an ink jet chamber and the throat transmits ink into the forward cavity to create a vortex with a swirling motion in the ink flowing into the ink jet chamber.

16. The restrictor plate of claim 15, wherein the swirling motion of the vortex transmits air from bubbles in the ink jet chamber toward an orifice located on one end of the ink jet chamber.

* * * * *